US005572093A

United States Patent [19]

Kiefer

[11] Patent Number: 5,572,093

[45] Date of Patent: Nov. 5, 1996

[54] REGULATION OF HOT RESTRIKE PULSE INTENSITY AND REPETITION

[75] Inventor: George E. Kiefer, Hendersonville, N.C.

[73] Assignee: General Electric Company, Schenectady, N.Y.

[21] Appl. No.: 306,869

[22] Filed: Sep. 15, 1994

[51] Int. Cl.[6] ..... H05B 41/00

[52] U.S. Cl. ..... 315/289; 315/290; 315/DIG. 5; 315/240; 315/209 CD

[58] Field of Search ..... 315/289, 290, 315/209 CD, DIG. 5, 225, 103, 174, 276, 240, 242, 287

[56] References Cited

U.S. PATENT DOCUMENTS

| | | | |
|---|---|---|---|
| 4,380,719 | 4/1983 | De Bijl et al. | 315/101 |
| 4,406,976 | 9/1983 | Wisbey et al. | 315/309 |
| 5,047,694 | 9/1991 | Nuckolls et al. | 315/290 |

*Primary Examiner*—Robert Pascal
*Assistant Examiner*—Arnold Kinkead
*Attorney, Agent, or Firm*—George E. Hawranko

[57] ABSTRACT

Included in a ballast circuit arrangement for a gas discharge lamp is a ballast transformer arrangement receptive of an input power signal and providing an output, ballast voltage. Further included is a pulse transformer having a secondary winding in serial circuit with the lamp for impressing a high voltage, hot restrike starting pulse across the lamp. A bypass capacitor is coupled to the ballast transformer for being charged by the ballast voltage. A hot restrike starting circuit for pulsing a primary winding of the pulse transformer comprises a serially connected starting capacitor and resistor coupled across the bypass capacitor; and a circuit for discharging the starting capacitor including, in serial circuit, the primary winding of the pulse transformer and a current switch having a control electrode responsive to a control signal. A trigger circuit for supplying such control signal comprises a serially connected trigger capacitor and resistor coupled across the starting capacitor; a circuit for discharging the trigger capacitor including a first voltage-breakover switch and producing the mentioned control signal when the first voltage-breakover switch becomes conductive; and a second voltage-breakover switch in serial circuit with the trigger resistor, between the trigger and starting capacitors. The foregoing arrangement provides multiple, consistently high, hot restrike pulses for restarting the lamp.

9 Claims, 4 Drawing Sheets

10
12
14
14A
14B
16
17
18
20A
20B
20C
22
24
24A
24B
24C
42
43
61
62
63
64
65
65A
65B
66
67
200
202
204
250
90
92
94
96
VB
TRIGGER CIRCUIT 60
STARTING CIRCUIT 40

REGULATION OF HOT RESTRIKE PULSE INTENSITY AND REPETITION

CROSS-REFERENCE TO RELATED APPLICATIONS

This application is related to the following, applications that are commonly owned by the present assignee: "System for Starting a High Intensity Discharge Lamp," Ser. No. 08/306,342, filed concurrently herewith and issued as U.S. Pat. No. 5,444,334 on Aug. 22, 1995; and "Boosting of Lamp-Driving Voltage During Hot Restrike," Ser. No. 08/306,800, filed concurrently herewith, and issued as U.S. Pat. No. 5,449,980 on Sep. 12, 1995. The disclosures of the foregoing applications are herein incorporated by reference.

FIELD OF THE INVENTION

The present invention relates to an arrangement for rapidly restarting a high intensity discharge (HID) lamp after it has turned off and, while still hot. More particularly, the invention is directed to an improvement for reliably providing multiple high voltage, hot restrike pulses during a half cycle of lamp-driving voltage, and for regulating the intensity of the pulses so as to consistently be high.

BACKGROUND OF THE INVENTION

High intensity discharge (HID) lamps are typically used where large areas require illumination, such as in factories, parking lots and sports arenas. In some applications, such as illuminating a sports arena during a sporting event, after a momentary power failure that terminates illumination by the lamps, it is naturally desired that the lamps rapidly restart to allow the sporting event to continue. However, a hot HID lamp typically requires a high current at an elevated voltage to cause the lamp to drop in voltage to where its power supply, or ballast, circuit can sustain lamp operation.

The above cross-referenced application entitled "System for Starting a High Intensity Discharge Lamp," Ser. No. 08/306,342, is directed to an improved hot restrike circuit for HID lamps that performs well over a long life. With reference to terminology employed herein, the hot restrike circuit of the co-pending application includes a starting circuit in which a starting capacitor is charged through a resistor, and discharged through the primary winding of a pulse transformer and a current switch when it becomes conductive (i.e. turns on). A secondary winding of the pulse transformer provides a high voltage, hot restrike pulse that is applied across the lamp to initiate lamp starting. Multiple high voltage, hot restrike pulses per half cycle of lamp-driving voltage can be provided to assure the high current at an elevated voltage needed to initiate lamp turn-on.

The current switch disclosed in the co-pending application has a control electrode that is controlled by a starting aid, which may be conventional per se. The specific current switch disclosed in the co-pending application is a three-electrode spark gap device that has a main spark gap formed between a pair of main electrodes, and a triggering spark gap formed between one of the main electrodes and a trigger (or control) electrode.

The starting aid, or "trigger" circuit as used herein, which provides the control signal for the current switch of the starting circuit, may typically include a trigger capacitor that is charged through a resistor. The trigger capacitor is then discharged through the primary winding of a pulse transformer, which has a secondary winding that generates a trigger pulse as the control signal to trigger into conduction the current switch of the starting circuit.

The use of a conventional starting aid in the hot restrike circuit of the co-pending application has enabled rapid restarting of an HID lamp of the metal halide variety. However, the present inventor has discovered that even further improvements in hot restrike capability can be achieved using the principles of the present invention. One improvement is to regulate the intensity of hot restrike pulses so that they are consistently at a high level. As such, the hot restrike pulses are more effective at delivering high current to the lamp. A further improvement is to increase the reliability of obtaining multiple hot restrike pulses during a half cycle of lamp-driving voltage, which also contributes to the effectiveness of the hot restrike pulses.

SUMMARY OF THE INVENTION

It is, accordingly, an object of the invention to provide, for a gas discharge lamp, a ballast circuit arrangement having a hot restrike capability, wherein the intensity of hot restrike pulses is regulated to be at a consistently high level.

A further object of the invention is to provide, for a gas discharge lamp, a ballast circuit arrangement having a hot restrike capability with the foregoing regulation-of-pulse-intensity advantage, and wherein an increase is realized in the reliability of obtaining multiple hot restrike pulses during a half cycle of lamp-driving voltage so as to increase the effectiveness of the hot restrike capability.

In accordance with a preferred embodiment of the invention, there is provided a ballast circuit arrangement for a gas discharge lamp, including a ballast transformer arrangement receptive of an input power signal and providing an output, ballast voltage. Further included is a pulse transformer having a secondary winding in serial circuit with the lamp for impressing a high voltage, hot restrike starting pulse across the lamp. A bypass capacitor is coupled to the ballast transformer for being charged by the ballast voltage. A hot restrike starting circuit for pulsing a primary winding of the pulse transformer comprises a serially connected starting capacitor and resistor coupled across the bypass capacitor; and a circuit for discharging the starting capacitor including, in serial circuit, the primary winding of the pulse transformer and a current switch having a control electrode responsive to a control signal. A trigger circuit for supplying such control signal comprises a serially connected trigger capacitor and resistor coupled across the starting capacitor; a circuit for discharging the trigger capacitor including a first voltage-breakover switch and producing the mentioned control signal when the first voltage-breakover switch becomes conductive; and a second voltage-breakover switch in serial circuit with the trigger resistor, between the trigger and starting capacitors. The second voltage-breakover switch allows the trigger capacitor to become charged only when the voltage on the starting capacitor exceeds a threshold voltage, thereby providing consistently high hot restrike pulses, and, further, reducing its current conduction after the trigger capacitor is discharged to below the holding current of the first voltage-breakover switch for a sufficient duration to allow the first switch to reset during the same half-cycle of the ballast voltage, whereby the starting circuit provides multiple hot restrike pulses in the same half-cycle.

Preferably, the current switch of the hot restrike circuit comprises a three-electrode spark gap device having a main spark gap formed between a pair of main electrodes, and a triggering spark gap formed between one of the main electrodes and a trigger electrode that is responsive to the mentioned control signal.

BRIEF DESCRIPTION OF THE DRAWING FIGURES

The foregoing, and further, objects and advantages of the invention will become apparent from the following description when read in conjunction with the drawing, in which.

DETAILED DESCRIPTION OF THE PREFERRED EMBODIMENTS

Figure 1:
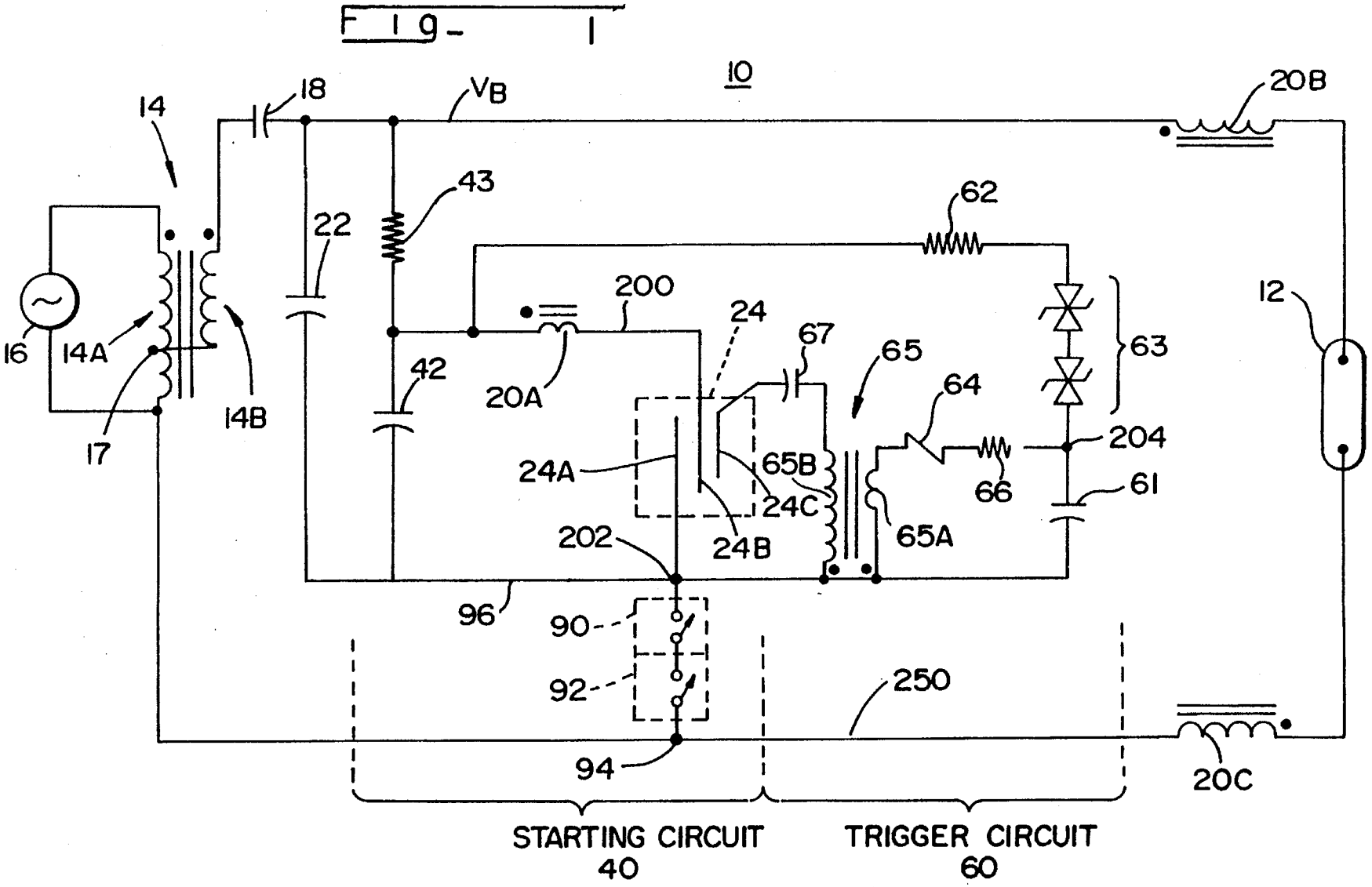
FIG. 1 is a schematic diagram of a ballast circuit arrangement for a gas discharge lamp that incorporates a trigger circuit for improving hot restrike capability in accordance with the invention.

FIG. 1 shows a ballast circuit arrangement 10 for powering a high intensity discharge (HID) lamp 12. A primary winding 14A of a ballast transformer 14 receives an a.c. power signal from source 16, and produces an output voltage on secondary winding 14B. Transformer 14 is known as an regulating transformer, and has a secondary winding 14B that is tapped into primary winding 14A at 17. A ballast capacitor 18 produces a desired phase angle between current and voltage supplied by source 16, and, in combination with ballast transformer 14, limits current to lamp 12. The type of ballast transformer used is not critical to the invention.

As will be described in detail below, starting circuit 40 and trigger circuit 60 cooperate to produce a pulse of current through a pulse transformer primary winding 20A. During this time, relays 90 and 92 (described below) between a circuit common 94 and conductor 96 are both closed. As a result, respective, additive high voltage (hot restrike) pulses are induced in secondary windings 20B and 20C of such pulse transformer. For a 2000-watt, 250-volt lamp, for instance, the high voltage would likely be in excess of 10 kilovolts for each pulse transformer. The high voltage pulses from windings 20B and 20C are impressed across lamp 12 as "hot restrike" pulses for initiating restarting of the lamp while the lamp is still hot. The use of the two secondary windings 20B and 20C has the advantage of reducing the peak lamp voltage relative to circuit common 94, since the windings create additive, opposite polarity voltages about circuit common 94. Only one secondary winding 20B or 20C could be used if desired, however.

A bypass capacitor 22 is coupled to secondary winding 14B of ballast transformer 14 so as to be charged by ballast voltage $V_B$. Bypass capacitor 22 prevents the high voltage, hot restrike pulses from damaging transformer 14.

Referring again to starting circuit 40, a starting capacitor 42 is charged from bypass capacitor 22 by current flowing through a resistor 43. A discharge circuit for capacitor 42 includes primary winding 20A of the above-described pulse transformer for producing hot restrike pulses. Capacitor 42 becomes discharged when a conductive state is established in current switch 24 between its main current-carrying electrodes 24A and 24B. This occurs when control electrode 24C of switch 24 receives an appropriate control signal from trigger circuit 60. With current switch 24 embodied as a three-electrode spark gap device as shown, a pulse of current supplied by trigger circuit 60 causes a spark discharge from control electrode 24C, through main electrode 24B, to main electrode 24A. This makes switch 24 conductive so that capacitor 42 discharges to circuit common 94 via pulse transformer primary winding 20A.

With current switch 24 being embodied as a three-electrode spark gap device, switch electrodes 24A–24C preferably comprise elongated conductive members that are substantially parallel to each other. Further details of such a three-electrode spark gap device are disclosed in the above cross-referenced application Ser. No. 08/306,342. As described below, however, other forms of switching devices that switch in response to a control signal on a control electrode are suitably used in the present invention.

To produce a control signal for switch 24, trigger circuit 60 incorporates a trigger capacitor 61 that is charged through a resistor 62 from starting capacitor 42. In serial circuit with resistor 62 is a voltage-breakover switch 63, which, as described below, significantly contributes to the advantages of the invention. When the voltage on capacitor 61 exceeds the breakover voltage of voltage-breakover switch 64, that switch becomes conductive and capacitor 61 discharges through such switch and primary winding 65A of a pulse transformer 65. Resistor 66, meanwhile, limits current to switch 64 to protect it from overheating.

When primary winding 65A of pulse transformer 65 receives the mentioned discharge from capacitor 61, a considerably higher voltage pulse is induced on secondary winding 65B. That pulse on secondary winding 65B is coupled to trigger (or control) electrode 24C of current switch 24, via a capacitor 67. Capacitor 67 blocks voltage at the operating frequency of ballast voltage $V_B$ from reaching secondary winding 65B, although a resistor could instead serve such purpose.

HIGH INTENSITY HOT RESTRIKE PULSES

Voltage-breakover switch 63, in the charging path for trigger capacitor 1, breaks over (i.e. becomes conductive) only when the voltage on starting capacitor 42 exceeds the breakover voltage of that switch 63. As a result, trigger capacitor 61 discharges through pulse transformer primary winding 65A, causing starting capacitor 42 to discharge through pulse transformer primary winding 20A only when the voltage on capacitor 42 is consistently high. In turn, the hot restrike pulses produced on pulse transformer secondary windings 20B and 20C is consistently high, and is thus more effective at delivering high current to the hot lamp for restarting the lamp. This is illustrated in FIG. 2.

Figure 2:
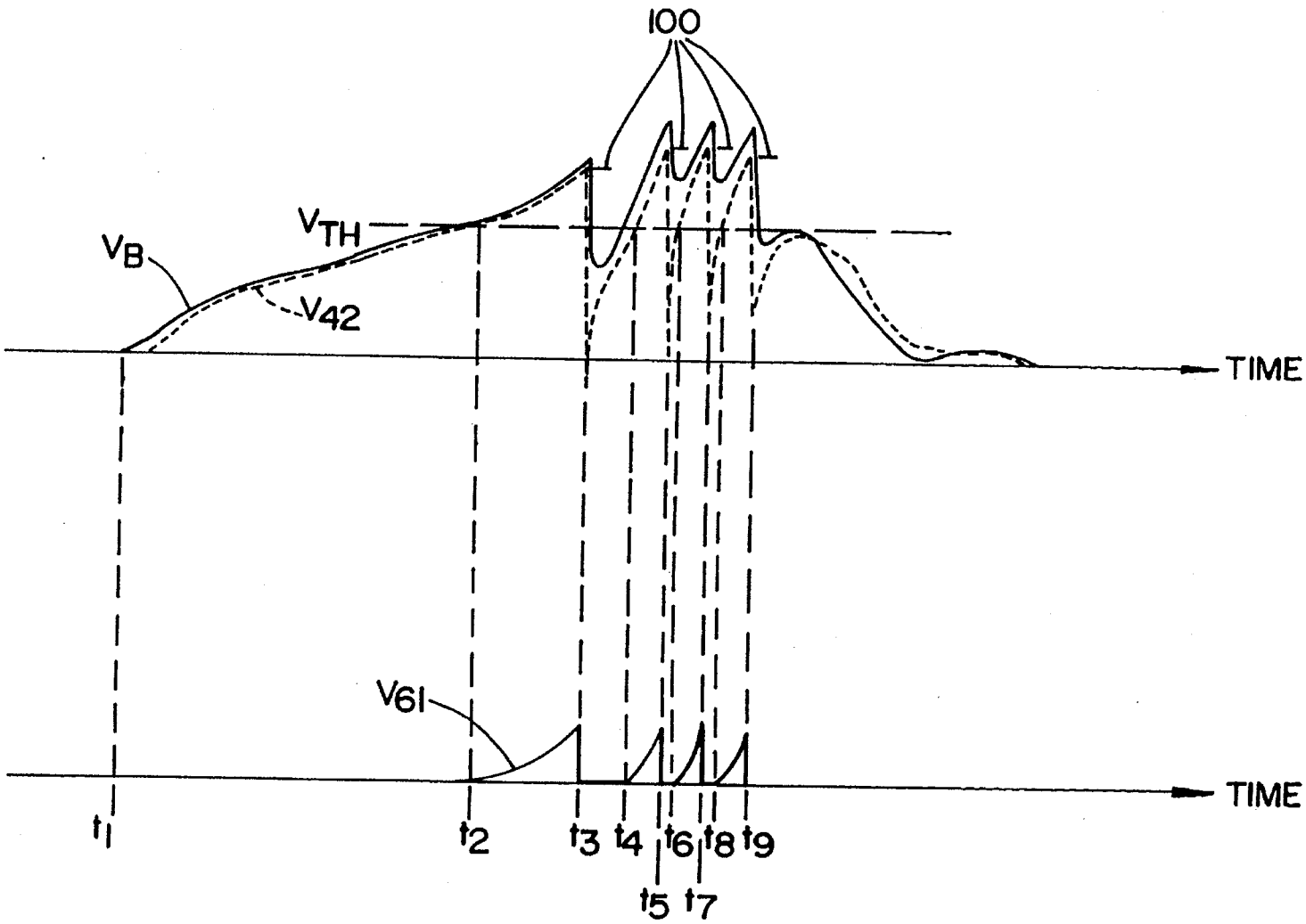
FIG. 2 show voltage waveforms for a ballast circuit arrangement similar to FIG. 1, but without using voltage-breakover switch 63 of trigger circuit 60.

The upper and lower curves in FIG. 2 show voltages $V_{42}$ and $V_{61}$ across starting capacitor 42 and trigger capacitor 61, respectively, for a half cycle of ballast voltage $V_B$ that appears on bypass capacitor 22. Ballast voltage $V_B$ becomes positive after its zero-crossing point $t_1$, and continues to rise until time $t_3$. Meanwhile, starting capacitor 42 becomes charged from ballast voltage $V_B$ via resistor 43, and its voltage ($V_{42}$) remains somewhat lower than ballast voltage $V_B$. At time $t_2$, the voltage $V_{42}$ on starting capacitor 42 reaches the breakover voltage of voltage-breakover switch 63 (FIG. 1), as indicated by a threshold voltage $V_{TH}$. With switch 63 now conductive, trigger capacitor 61 starts charging from starting capacitor 42 and continues to charge until its voltage $V_{61}$ exceeds the breakover voltage of voltage-breakover switch 64. At this point, time $t_3$, switch 64 becomes conductive and capacitor 61 discharges through pulse transformer 65. This turns on current switch 24 and causes starting capacitor 42 to discharge through pulse transformer primary winding 20A. Respective hot restrike pulses on pulse transformer secondary windings 20B and 20C are thereby produced, as described above.

The foregoing process occurring between times $t_2$ and $t_3$ repeats between times $t_4$ and $t_5$, $t_6$ and $t_7$, and $t_8$ and $t_9$. The peaks of voltage $V_{42}$ on capacitor 42, as shown at points 100, are consistently high as desired, to achieve a high intensity of hot restrike pulses. During the negative half cycles of ballast voltage, the waveforms for the voltages shown in FIG. 2 for a positive half cycle are repeated, but in the negative direction.

Figure 3:
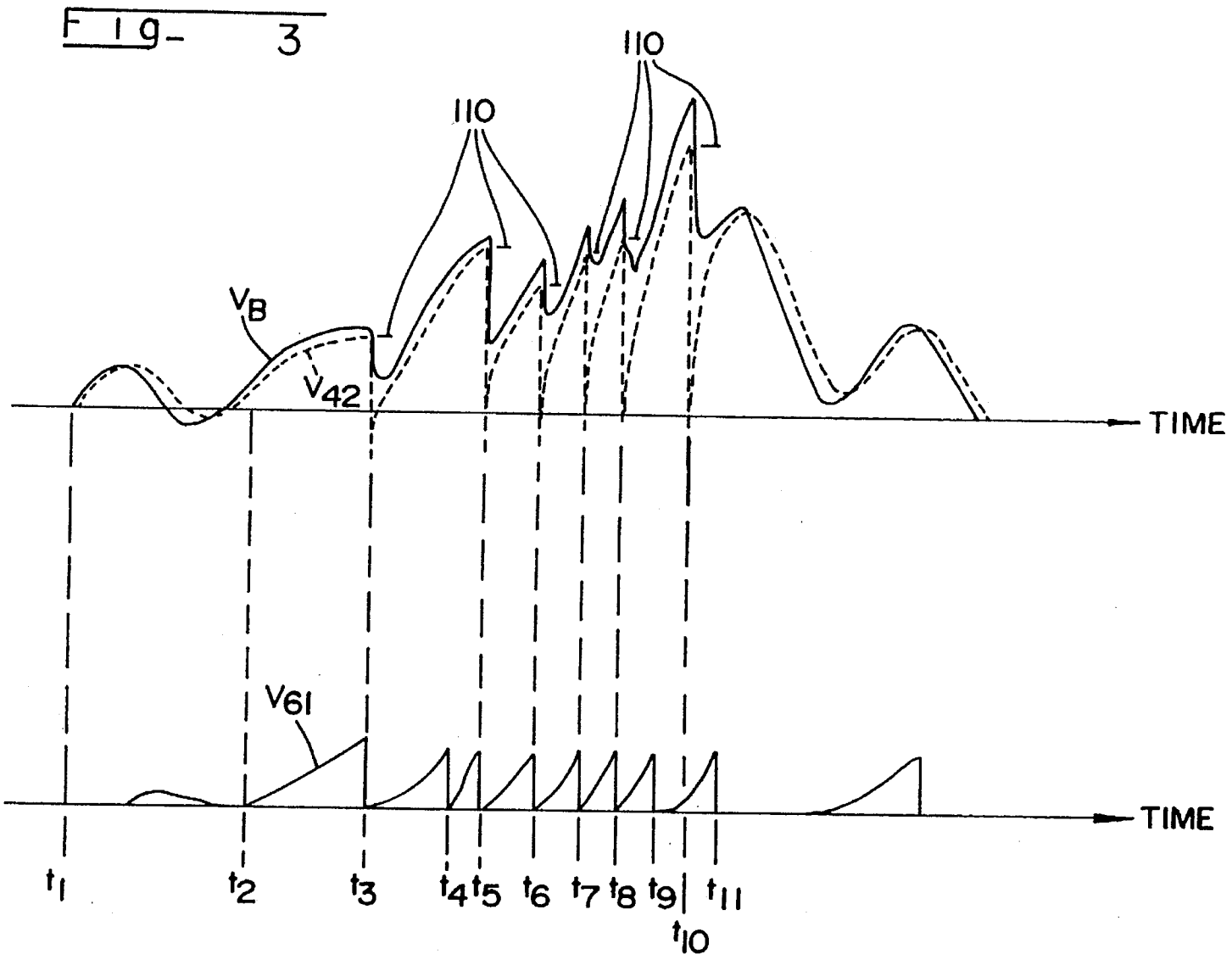
FIG. 3 show voltage waveforms for the ballast circuit arrangement of FIG. 1, including voltage-breakover switch 63 of trigger circuit 60.

FIG. 3 provides a contrast with FIG. 2 where a voltage-breakover switch 63 (FIG. 1) is not used in trigger circuit 60. Instead, the value of resistor 62 is increased to set an appropriate time constant for charging capacitor 61. At time $t_2$ in FIG. 3, trigger capacitor 61 starts charging from starting capacitor 42, as shown by voltage $V_{61}$ starting to rise. At time 13, capacitor 61 becomes charged to the breakover voltage of switch 64 (FIG. 1), whereupon switch 64 turns on to allow capacitor 61 to discharge through pulse transformer 65. This, in turn, causes current switch 24 to become conductive, causing capacitor 42 to discharge through pulse transformer primary winding 20A, producing hot restrike pulses on secondary windings 20B and 20C.

Capacitor 61 charges between time $t_3$ and time $t_4$, and discharges (or "fires") at time $t_4$; however, this firing is insufficient to produce an adequate control signal on trigger electrode 24C of current switch 24. Although not illustrated in FIG. 2, such misfiring of capacitor 61 can occur even though voltage-breakover switch 63 is employed. A way to reduce such misfiring, which involves increasing the breakover voltage of trigger switch 64, is disclosed in the above-referenced application Ser. No. 08/306,800.

The foregoing process occurring between times $t_2$ and $t_3$, where starting capacitor 42 becomes discharged, repeats between times $t_4$–$t_5$, $t_5$–$t_6$, $t_6$–$t_7$, and $t_7$–$t_8$. At time $t_9$ another misfiring of trigger capacitor 61 occurs, where (as described above) current switch 24 is not turned on. Then at time $t_{10}$, in the absence of trigger capacitor 61 firing, starting capacitor 42 fires. This is due to a somewhat rare, spontaneous voltage breakdown between main electrodes 24A and 24B of switch 24, which may occur due to close spacing between such electrodes and a recent history of repeated sparking between such electrodes.

In FIG. 3, the peaks of voltage $V_{42}$ on capacitor 42, as shown at points 110, are not consistently high as shown in FIG. 2, resulting in a lax regulation of intensity of hot restrike pulses. This is because, without breakover switch 63 in trigger circuit 60, trigger capacitor 61 starts charging when its voltage is surpassed by the voltage $V_{42}$ on starting capacitor 42. Consequently, capacitor 42 discharges through pulse transformer primary winding 20A even at relatively low values of voltage $V_{42}$, as shown by the left-most of points 110 in FIG. 3, for instance. During the negative half cycles of ballast voltage, the waveforms for the voltages shown in FIG. 3 for a positive half cycle are repeated, but in the negative direction.

MULTIPLE PULSING

The use of a voltage-breakover switch 63 in trigger circuit 60 (FIG. 1), such as a SIDAC, provides for consistently high hot restrike pulses as described above. However, it has been found by the present inventor that the type of device or devices implementing voltage-breakover switch 63 has important consequences. After trigger capacitor 61 has discharged, it typically will have a harmonic voltage (or "ring") on it that tends to keep switch 64 conducting. It is important, however, for switch 64 to rapidly reset, i.e. to again block current until turned on by sufficient voltage on capacitor 61. This allows trigger capacitor 61 to reliably recharge and be discharged during a half-cycle of ballast voltage, so that starting circuit 40 provides multiple hot restrike pulses in the same half-cycle. For the specific component values set forth below, it is preferred that at least 4 hot restrike pulses per half cycle are produced.

When a SIDAC, or several series-connected SIDACS, for instance, are used for switch 64, the switch has a low holding current, which decreases even more at increasing temperatures. To turn off such a SIDAC requires that the current supplied to it, i.e., via switch 63, decrease to below its holding current for a sufficient duration of time to allow the SIDAC to reset (i.e. block current). For the specific component values set forth below, at least about 10 microseconds, and preferably above about 50 microseconds, is preferred. This can be accomplished through suitable selection of switch 63.

Voltage-breakover switch 63 may, for instance, comprise a transient diode, whose electrical function is modelled as back-to-back Zener diodes. After the voltage across a transient diode decreases below its breakover voltage, its current rapidly reduces to well below the holding current of a SIDAC (or other semiconductor) switch 64. Alternatively, such back-to-back Zener diodes may be used, and the selection of other suitable component(s) to implement switch 63 will be routine to those of ordinary skill in the art in view of the present specification.

It is true that FIG. 3 illustrates multiple pulses during a half-cycle of ballast voltage although voltage-breakover switch 63 is not used, and is thus not available to "pinch" off the current to switch 64; however, such grouping of multiple pulses for the resulting circuit was not reproduced reliably. Thus, many half cycles occurred with the production of only a single pulse per half cycle.

Figure 4:
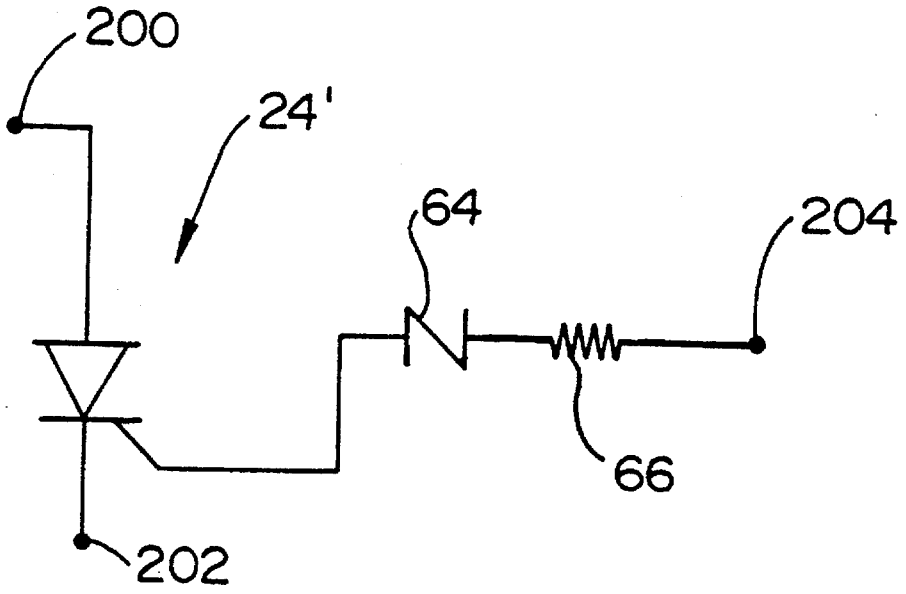
FIG. 4 is shows an alternative circuit between nodes 200, 202 and 204 that can replace the corresponding circuit in FIG. 1 between the same-numbered nodes.

FIG. 4 shows an alternative current switch 24' that can be used instead of the three-electrode spark gap device shown in FIG. 1, at least for lower lamp wattage. Specifically, the circuit of FIG. 4, between nodes 200, 202 and 204, can replace the corresponding circuit in FIG. 1 between the same-numbered nodes. As can be seen from FIG. 4, pulse transformer 65 (FIG. 1) of trigger circuit 60 is not used in the circuit shown. The current switch 24' in FIG. 4, by way of example, may be an SCR, as illustrated, a triac, or, when using the invention of above-referenced application 08/306,800, for instance, by a transistor such as a bipolar transistor, an insulated-gate transistor, or a power field-effect transistor. The so-modified circuit of FIG. 1 operates in the same general fashion as described above, except, of course, for the absence of pulse transformer 65.

Relays 90 and 92 of FIG. 1 are now considered, relay 90 being a timer relay, and relay 92 being a lamp-current relay.

Timer relay 90, which is normally open, is responsive to a.c. line voltage, e.g. from power source 16. When power is first supplied to the ballast circuit arrangement 10 of FIG. 1, a first timer function causes relay 90 to close and then to subject the hot restrike circuitry to a duty cycle of about 1:10 so as to minimize stresses on such circuitry. For instance, relay 90 may close within about 50 milliseconds of a.c.

power being applied, and, to complete a duty cycle, remain closed for about 200 milliseconds, and open for about 2 seconds. If the lamp has not started within, for instance, 20 of the mentioned duty cycles, a second timer function opens the relay to shut off power to the hot restrike circuitry; it is also desired at this time that power to the circuitry (not shown) implementing the foregoing timer functions be shut off in such a manner that the timer resets. Implementing timer relay 90 will be routine to those of ordinary skill in the art based on the present specification.

Lamp-current relay 92, which is normally closed, senses current in lamp 12. It can be implemented, e.g., with a standard current relay whose current-sensing winding (not shown) is placed in conductor line 250 leading to the lamp.

In a specific example of implementing the ballast circuit arrangement of FIG. 1, the following component values may be used for a 250-volt, 2000-watt metal halide lamp, wherein polarities of transformer windings are indicated by dots in FIG. 1: Ballast transformer 14, an auto-regulator ballast providing 8.5 amps lamp current to a 250-volt lamp; ballast capacitor 18, 50 microfarads; ballast voltage $V_B$, 800 volts peak; bypass capacitor 22, 1.0 microfarads; starting capacitor 42, 1.0 microfarads; resistor 43, 0.1 k ohms; pulse transformer 20A–20C comprising two coils and core assemblies with the primary winding 20A comprising 1 turn on each coil, and secondary windings 20B and 20C each respectively comprising 48 turns on its associated coil; main electrodes 24A and 24B of switch 24 each comprising tungsten rods of 3/16" diameter, separated from each other by a gap of 0.09 inches, and having a breakdown rating between such electrodes from 1.0 to 2.0 kilovolts; trigger electrode 24C of switch 24 comprising a tungsten rod of 3/16" diameter, separated by a gap of 0.017 inches from adjacent electrode 24B, with a breakdown rating between electrodes 24B and 24C between 5 and 7 kilovolts; a turns ratio between primary (pulse) winding 65A and secondary (pulse) winding 65B of 56.8:1; voltage-breakover switch 64, one or more serially connected SIDACS having a total breakover voltage of 220 volts, such as available under Part No. KIV24 from Shidengen Electric Mfg. Co. Ltd. of Tokyo, Japan; resistor 66, 5 ohms; trigger capacitor 61, 0.1 microfarads; resistor 62, 1.0 k ohms; and voltage-breakover switch 63, one or more serially connected transient diodes, such as Part No. PGK-SERIES from Motorola of Phoenix, Arizona, and having a total breakover voltage of 400 volts.

From the foregoing, it will appreciated that the invention provides, for a gas discharge lamp, a ballast circuit arrangement having a hot restrike capability, wherein the intensity of hot restrike pulses is regulated to be at a consistently high level, and wherein an increase is realized in the reliability of obtaining multiple hot restrike pulses during a half cycle of lamp-driving voltage so as to increase the effectiveness of the hot restrike capability.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A ballast circuit arrangement for a gas discharge lamp, comprising:

(a) a ballast transformer arrangement receptive of an input power signal and providing an output, ballast voltage having positive and negative half cycles;

(b) a pulse transformer having a secondary winding in serial circuit with the lamp for impressing a high voltage, hot restrike starting pulse across the lamp;

(c) a bypass capacitor coupled to said ballast transformer for being charged by the ballast voltage;

(d) a hot restrike starting circuit for pulsing a primary winding of said pulse transformer, comprising a serially connected starting capacitor and resistor coupled across said bypass capacitor; and a circuit for discharging said starting capacitor including, in serial circuit, said primary winding of said pulse transformer and a current switch having a control electrode responsive to a control signal; and (e) a trigger circuit for supplying said control signal, comprising a serially connected trigger capacitor and trigger resistor coupled across said starting capacitor; a circuit for discharging said trigger capacitor including a first voltage-breakover switch and producing said control signal when said first voltage-breakover switch becomes conductive; and a second voltage-breakover switch in serial circuit with said trigger resistor, between said trigger and starting capacitors; said second voltage-breakover switch allowing said trigger capacitor to become charged only when the voltage on said starting capacitor exceeds a threshold voltage, thereby providing consistently high hot restrike pulses, and, further, reducing its current conduction after said trigger capacitor is discharged to below the holding current of said first voltage-breakover switch for a sufficient duration to allow said first voltage-breakover switch to reset during the same half-cycle of said ballast voltage, whereby said starting circuit provides multiple hot restrike pulses in said same half-cycle.

2. The ballast circuit arrangement of claim 1, wherein said second voltage-breakover switch comprises at least one of a group consisting of transient diodes and back-to-back connected Zener diodes.

3. The ballast circuit arrangement of claim 1, wherein said current switch of said starting circuit comprises a semiconductor device having a pair of main current-carrying electrodes and a control electrode receptive of said control signal.

4. The ballast circuit arrangement of claim 1, wherein said first voltage-breakover switch comprises at least one SIDAC.

5. The ballast circuit arrangement of claim 1, wherein said first voltage-breakover switch comprises a semiconductor device with a holding current of less than about 100 milliamperes.

6. A ballast circuit arrangement for a gas discharge lamp, comprising:

(a) a ballast transformer arrangement receptive of an input power signal and providing an output, ballast voltage having positive and negative half cycles;

(b) a pulse transformer having a secondary winding in serial circuit with the lamp for impressing a high voltage, hot restrike starting pulse across the lamp;

(c) a bypass capacitor coupled to said ballast transformer for being charged by the ballast voltage;

(d) a hot restrike starting circuit for pulsing a primary winding of said pulse transformer, comprising a serially connected starting capacitor and resistor coupled across said bypass capacitor; and a circuit for discharging said starting capacitor including, in serial circuit, said primary winding of said pulse transformer and a three-electrode spark gap device having a main spark gap formed between a pair of main electrodes, and a triggering spark gap formed between one of the main electrodes and a trigger electrode that is responsive to a control signal; and (e) a trigger circuit for supplying said control signal, comprising a serially connected trigger capacitor and trigger resistor coupled across said starting capacitor; a circuit for discharging said trigger capacitor including a first voltage-breakover switch and producing said control signal when said first voltage-breakover switch becomes conductive; and a second voltage-breakover switch in serial circuit with said trigger resistor, between said trigger and starting capacitors; said second voltage-breakover switch allowing said trigger capacitor to become charged only when the voltage on said starting capacitor exceeds a threshold voltage, thereby providing consistently high hot restrike pulses, and, further, reducing its current conduction after said trigger capacitor is discharged to below the holding current of said first voltage-breakover switch for a sufficient duration to allow said first voltage-breakover switch to reset during the same half-cycle of said ballast voltage, whereby said starting circuit provides multiple hot restrike pulses in said same half-cycle.

7. The ballast circuit of claim 6, wherein said main and trigger electrodes of said spark gap device comprise elongated conductive members that are substantially parallel to each other.

8. The ballast circuit arrangement of claim 6, wherein said first voltage-breakover switch comprises at least one SIDAC.

9. The ballast circuit arrangement of claim 6, wherein said first voltage-breakover switch comprises a semiconductor device with a holding current of less than about 100 milliamperes.

* * * * *